United States Patent [19]

Tanaka et al.

[11] Patent Number: 5,030,367

[45] Date of Patent: Jul. 9, 1991

[54] WATER-DISPERSION LUBRICANT OF GRAPHITE, PARTICULATE RESIN AND HIGH MOLECULAR WEIGHT POLYBASIC ACID SALT

[75] Inventors: Megumu Tanaka; Koji Sakura, both of Yokohama; Tatsuharu Oda, Chigasaki; Tomoyuki Hirakawa, Yokohama; Yasuhiro Sotani, Tokyo; Fuyuhiko Kajiyama, Yokohama; Noboru Kanda, Hiratsuka; Hiroo Hosono, Samukawa; Toshitaka Wakabayashi, Chigasaki; Hitoshi Hasegawa, Samukawa, all of Japan

[73] Assignees: Nippon Kokan Kabushiki Kaisha; Yushiro Chemical Industry Co., Ltd., both of Japan

[21] Appl. No.: 400,918

[22] Filed: Aug. 30, 1989

[30] Foreign Application Priority Data

Aug. 30, 1988 [JP] Japan ..... 63-213622
Aug. 30, 1988 [JP] Japan ..... 63-213623

[51] Int. Cl.[5] ..... C10M 173/02

[52] U.S. Cl. ..... 252/22; 252/49.5; 252/56 R

[58] Field of Search ..... 252/22, 49.5, 56 R

[56] References Cited

U.S. PATENT DOCUMENTS 4,001,125 1/1977 Newton, III .
4,052,323 10/1977 Feneberger et al. ..... 252/22
4,401,579 8/1983 Kratzer ..... 252/22
4,711,733 12/1987 Kanda et al. .
4,735,734 4/1988 Staub et al. ..... 252/22
4,808,324 2/1989 P'eriard et al. ..... 252/22

FOREIGN PATENT DOCUMENTS 185393 11/1982 Japan .
138795 8/1983 Japan .
37317 9/1984 Japan .
240796 11/1985 Japan .
17639 4/1987 Japan .
34356 7/1987 Japan .
34357 7/1987 Japan .
268584 2/1969 U.S.S.R. ..... 252/22
540906 11/1975 U.S.S.R. ..... 252/22
586195 5/1976 U.S.S.R. ..... 252/22

*Primary Examiner*—Prince E. Willis
*Assistant Examiner*—Jerry D. Johnson
*Attorney, Agent, or Firm*—Lowe, Price, LeBlanc & Becker

[57] ABSTRACT

Disclosed herein is a water-dispersion-type hot-rolling lubricant for the production of seamless steel pipes. This lubricant features the inclusion of a salt of a polybasic high molecular acid in addition to fine graphite powder, a water-insoluble fine particulate synthetic resin and water as principal components and fine gilsonite powder as an optional component. Even when the surface temperature of a mandrel bar is in a high temperature range of 100°–400° C., this lubricant can form a uniform and thick coating film on the surface of the bar so that the lubricant can exhibit extremely good hot-rolling lubrication performance.

8 Claims, 2 Drawing Sheets

WATER-DISPERSION LUBRICANT OF GRAPHITE, PARTICULATE RESIN AND HIGH MOLECULAR WEIGHT POLYBASIC ACID SALT

FIELD OF THE INVENTION

This invention relates to a water-dispersion-type hot-rolling lubricant for the production of seamless steel pipes, and especially to an improvement in a lubricant for a mandrel bar upon formation of pipes on a mandrel mill.

More specifically, the present invention is concerned with a lubricant for mandrel bars, which can form a uniform and thick film in a high temperature range (i.e., 100°–400° C.) when spray-coated and can provide a dry film having excellent water resistance and impact resistance and capable of exhibiting good lubrication.

Accordingly, this invention is useful in the lubricant industry and seamless steel pipe manufacturing industry.

As lubricants for the production of seamless steel pipes, there are generally used so-called oil-type lubricants formed of an oil (for example, heavy oil, waste oil or the like) and graphite powder mixed therein and so-called water-dispersion-type lubricants formed of water and graphite powder dispersed therein.

Oil-type lubricants give off a lot of smoke or flame, so that they deteriorate working environments and are fire hazards. To improve such problems of oil-type lubricants, water-dispersion-type lubricants have been developed.

Water-dispersion-type lubricants reported so far include compositions in which graphite has been dispersed in water by means of a dispersant (Japanese Patent Publication No. 17639/1987), compositions making use of a synthetic resin as a binder for graphite (Japanese Patent Application Laid-Open No. 138795/1983, Japanese Patent Publication No. 37317/1984, and Japanese Patent Publication No. 34357/1987), and compositions in which gilsonite powder has been added to improve the adhesion of a film to the surface of a mandrel bar (U.S. Pat. No. 4,711,733, which corresponds to Japanese Patent Application Laid-Open No. 240796/1985, now, Japanese Patent Publication No. 34356/1987).

However, these water-dispersion-type lubricants are accompanied by the drawback that when spray-coated onto a mandrel bar having a surface temperature in the high temperature range (i.e., 100°–400° C.), they do not have adhesion high enough to provide a uniform and thick film and hence to exhibit sufficient lubrication effects.

U.S. Pat. No. 4,001,125 discloses a lubricant comprising graphite and gilsonite. When the surface temperature of a mandrel bar is relatively low, for example, 100° C. or lower, this lubricant however has low adhesion to the mandrel bar so that the resulting film has poor water resistance and cannot exhibit lubrication effects.

The lubricant of Japanese Patent Application Laid-Open No. 185393/1982 comprises graphite, gilsonite and a synthetic resin. Its lubricity is however reduced when the temperature of a mandrel bar rises to or beyond 250° C.

OBJECT AND SUMMARY OF THE INVENTION

An object of this invention is to solve the drawbacks of the conventional water-dispersion-type lubricants and to provide a lubricant for the production of seamless steel pipes, said lubricant being capable of forming a uniform and thick film on the surface of a mandrel bar to show excellent hot-rolling lubrication performance even when the surface temperature of the mandrel bar is in the high temperature range of 100°–400° C.

The present inventors have found that the above object can be attained by incorporating a salt of a specific polybasic high-molecular acid in a lubricant. The lubricant with the salt of the specific polybasic high-molecular acid incorporated therein has been found to form a uniform and thick lubrication film on the surface of a mandrel bar and to show excellent hot-rolling lubrication performance even when the surface temperature of the mandrel bar is in the high temperature range (i.e., 100°–400° C.). Therefore, the lubricant has been found to be extremely good as a lubricant for the production of seamless steel pipes.

Namely, this invention provides an improved lubricant for the production of seamless steel pipes. The lubricant comprises fine graphite powder, a water-insoluble fine particulate synthetic resin and water as principal components. The lubricant further comprises a salt of a polybasic high molecular acid.

DETAILED DESCRIPTION OF THE INVENTION

Figure 1:
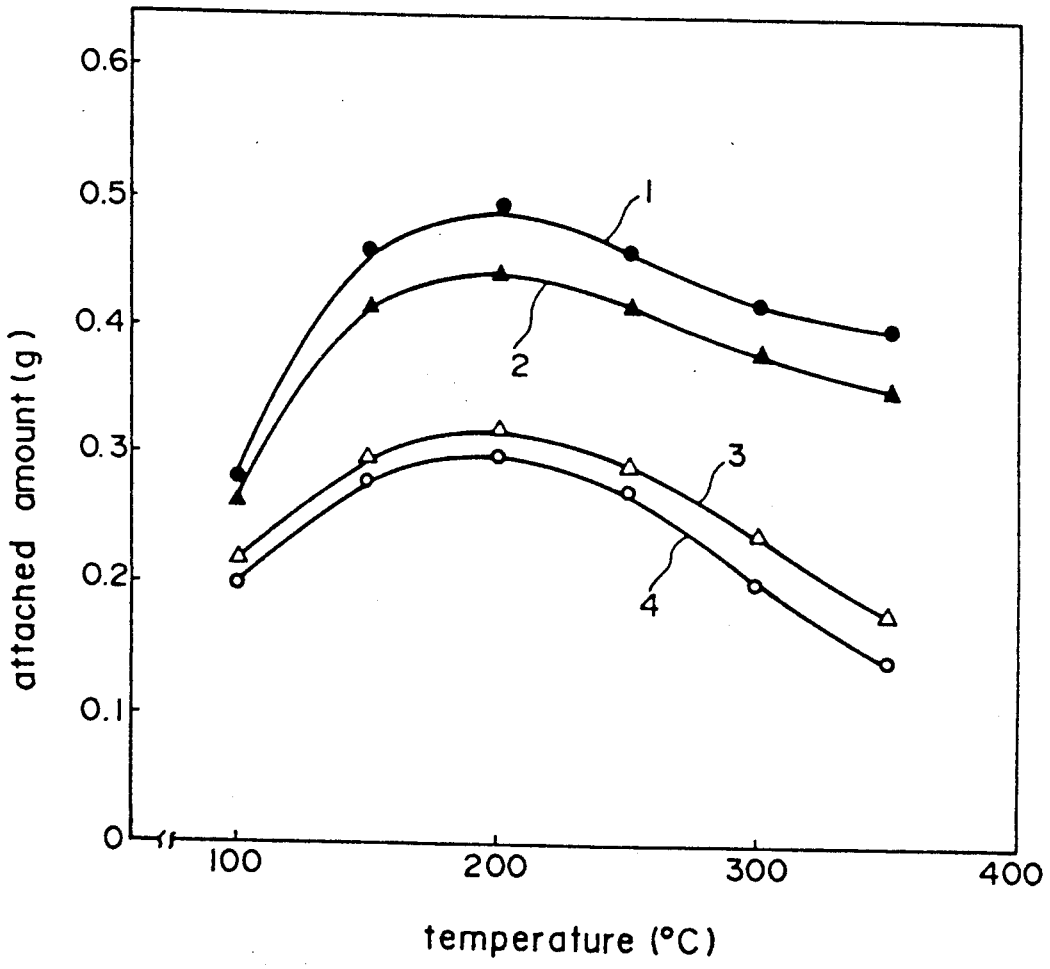
FIG. 1 diagrammatically illustrates the adhesion of the lubricants of Invention Examples 1 and 5 and the lubricants of Comparative Examples A and B.

Features of the present invention will hereinafter be described in detail.

Salt of Polybasic High-Molecular Acid

Suitable examples of the salt of the polybasic high-molecular acid employed in this invention include the sodium, potassium, calcium, magnesium, ammonium and amine salts of humic, nitrohumic and lignin sulfonic acids.

Alkanolamines such as monoisopropanolamine, diethanolamine, triethanolamine and triisopropanolamine may be mentioned as amines suitable for the formation of the amine salts.

These salts may be used either singly or in combination. It is suitable to add one or more of these salts in an amount such that the total concentration falls within a range of 0.01–5 wt.% in the resulting water dispersion. Amounts smaller than 0.01 wt.% are too little to draw out the effects of the present invention.

Fine Graphite Powder

Any fine graphite powder is usable in this invention whether it is of a natural origin or is a synthesized product or whether it is in a amorphous form or in a flake-like form. However, the average particle size is desirably not greater than 100 μm from the standpoint of the dispersion stability of graphite and the maintenance and control of a lubricant applicator.

Fine Gilsonite Powder

Fine gilsonite powder can also be used in this invention if desired. The use of other asphalt however results in reduced adhesion at the time of film formation, especially in extreme deteriorations of the adhered amount and adhesion strength when recoated.

Fine gilsonite powder may desirably have an average particle size not greater than 100 μm in view of the dispersion stability of gilsonite and the maintenance and control of the lubricant applicator. Fine gilsonite powder may be added suitably in an amount such that its concentration ranges from 5 wt.% to 30 wt.% in a lubricant for the production of seamless steel pipes.

Fine Particulate Synthetic Resin

As the fine particulate synthetic resin employed in this invention, it is possible to use any one of fine particulate synthetic resins routinely used as lubricant components. Illustrative examples include polyacrylic resins, polyvinyl acetate resins, poly(modified vinyl acetate) resins, polystyrene resins, polyethylene resins, polyepoxy resins, etc.

Suitable polyacrylic resins may be homopolymers and copolymers of lower alkanol esters of acrylic acid and methacrylic acid. Lower alkanols having 1–4 carbon atoms are appropriate as the lower alkanols for the esters.

Further, suitable copolymers of lower alkanol esters of acrylic acid or methacrylic acid may include copolymers of these esters and vinyl acetate, copolymers of these esters and styrene, copolymers of these esters and acrylonitrile, copolymers of these esters and acryloamide, and copolymers of these esters and acrylic acid.

Suitable vinyl acetate resins may include homopolymer of vinyl acetate, copolymers of vinyl acetate and maleic acid, copolymers of vinyl acetate and fumaric acid, and copolymers of vinyl acetate and ethylene.

Optional Additives

As has been described above, the lubricant of this invention is basically of fine graphite powder, fine powder of a water-insoluble synthetic resin, water and a salt of a polybasic high-molecular acid. Fine gilsonite may also be added if necessary. It should however be noted that the effects of this invention will not be reduced by the addition of other component or components, for example, one or more of surfactants, polymer dispersants, pH adjustors, thickening agents, etc. It is therefore possible to optionally add one or more of surfactants, polymer dispersants, pH adjustors, thickening agents and the like as needed with a view toward converting the above basic components into a stable water dispersion.

Manner of Use

Upon application of the lubricant of this invention, it can be use in a form diluted with water. The preferable degree of dilution varies depending on the processing conditions and coating conditions. In general, the lubricant of this invention can be used by diluting it to such a degree that the total amount of its essential components, namely, fine graphite powder, fine powder of the water-insoluble synthetic resin and the salt of the polybasic high-molecular acid, plus fine gilsonite powder and auxiliary components if any may account for 30–70 wt.% of the resulting diluted coating formulation.

ADVANTAGES OF THE INVENTION

The lubricant of this invention for the production of seamless steel pipes, namely, the lubricant for the production of seamless steel pipes—said lubricant containing one or more salts selected, for example, from salts of humic acid, nitrohumic acid and lignin sulfonic acid—can form a uniform and thick dry film and can exhibit good rolling lubrication performance. The use of the lubricant of this invention therefore makes it possible to save the mill-driving power consumption and also to stabilize rolling operations.

In contrast, lubricants for the production of seamless steel pipes, which contains graphite powder and a fine particulate synthetic resin as principal components or graphite powder, gilsonite and a fine particulate synthetic resin as principal components but do not contain any salt of polybasic high-molecular acid unlike the present invention, have poor adhesion when the surface temperature of a mandrel bar is high, especially, 150° C. or higher, whereby they cannot provide any uniform dry film.

EMBODIMENTS OF THE INVENTION

To further facilitate the understanding of this invention, some experiments and examples of this invention will hereinafter be described. It should however be borne in mind that the present invention is not necessarily limited to or by the following experiments and examples.

Experiment and Examples without Gilsonite

Experiment 1:

Regarding the compositions given in Table 1, their adhesion, namely, amounts adhered and uniformity of films were investigated. The results are shown in FIG. 1 and Table 2.

The coating a mandrel bar with each lubricant was conducted upon movement of the mandrel bar. The moving speed of the mandrel was 1–4 m/sec. In view of this, an adhesion experiment was conducted under the following dynamic test conditions.

After spray-coating with a sample lubricant a steel pipe of 90 mm across, 4 mm thick and 150 mm long which was moving at a speed of 2.0 m/sec and had been heated to a predetermined temperature, the amount (g) of the film adhered on the surface of the steel pipe and the uniformity of the film were investigated.

The following spraying conditions were employed:

Pump: Airless Pump 206T (trade name, manufactured by Graco Inc.), compression ratio: 10:1.

Spray gun: Automatic Gun 24AUA (trade name, manufactured by Spraying Systems Co.)

Nozzle diameter: 0.61 mm.

Spray distance: 200 mm.

Discharge pressure: 40 kgf/cm$^2$.

Discharge: 30 g/s.

Temperature of steel pipe: 60°–400° C.

Dilution: Each sample lubricant was spray-coated as a 45 wt.% water dispersion.

Adhered amount (g): Average of five runs.

TABLE 1

| | Compositions of Sample Lubricants | | | | | | |
|---|---|---|---|---|---|---|---|
| | Example | | | | | Comp. Ex. | |
| Sample No. | 1 | 2 | 3 | 4 | 5 | A | B |
| Natural graphite (crystalline) | 65 | 65 | 65 | 65 | 65 | 65 | 65 |
| Polyacrylic resin | 35 | | | 34 | 31 | 35 | |
| Polyvinyl acetate resin | | 35 | 34.5 | | | | 35 |
| Ammonium salt of humic acid | 0.02 | | | | 3 | | |
| Sodium salt | | 0.05 | | | | | |

TABLE 1-continued

| Compositions of Sample Lubricants | | | | | | | |
|---|---|---|---|---|---|---|---|
| | Example | | | | | Comp. Ex. | |
| Sample No. | 1 | 2 | 3 | 4 | 5 | A | B |
| of humic acid | | | | | | | |
| Ammonium salt of nitrohumic acid | | | 0.5 | | | | |
| Sodium salt of of lignin sulfonic acid | | | | 1 | 1 | | |

Remarks:
(1) Samples A and B are conventional lubricants.
(2) Samples 1-5 are lubricants according to this invention.
(3) The proportions are expressed in terms of parts by weight.
(4) The polyacrylic resin is a copolymer of 27 parts by weight of butyl methacrylate and 73 parts by weight of methyl methacrylate.
(5) The polyvinyl acetate resin is a copolymer of 80 parts by weight of vinyl acetate and 20 parts by weight of ethylene.
(6) In FIG. 1, Curves 1, 2, 3 and 4 correspond to Sample Nos. 2, 1, B and A, respectively.

TABLE 2

| Uniformity of Coated Films | | | | | | | |
|---|---|---|---|---|---|---|---|
| Temperature of steel pipe (°C.) | Sample No. | | | | | | |
| | 1 | 2 | 3 | 4 | 5 | A | B |
| 60 | B | B | B | B | B | B | B |
| 100 | B | B | B | B | B | B | B |
| 150 | A | A | A | A | A | C | C |
| 200 | A | A | A | A | A | C | C |
| 250 | A | A | A | A | A | C | C |
| 300 | A | A | A | A | A | C | C |
| 350 | A | A | A | A | A | C | C |
| 400 | A | A | A | A | A | C | C |

Remarks:
A: Very dense dry film was formed.
B: Undried film was formed.
C: Extremely non-uniform film was formed.

| Example 1: (Sample No. 1) | |
|---|---|
| (Lubricant composition) | Parts by weight |
| Natural graphite (crystalline) | 65 |
| Polyacrylic resin | 35 |
| Ammonium salt of humic acid | 0.02 |

The above composition was added with water to form a dispersion. The concentration of the above composition in the dispersion was 45 wt.%. The dispersion was continuously applied during the hot-rolling of 200 seamless steel pipes on a mandrel mill. A mandrel bar which was moving at a speed of 2.0 m/sec was coated with the lubricant by means of the airless sprayer. During that time, the surface temperature of the mandrel bar ranged from 100° C. to 250° C. The resultant films of the lubricant were all uniform and adhered firmly. They had a thickness of from 30 μm to 40 μm. Compared with the conventional lubricant as Comparative Example A, more uniform and thicker films were formed.

As a result, the coefficient of friction was as small as 80% or less compared with the comparative example, leading to improvements such that the mill-driving power consumption was reduced by about 15% and the rolling operation was stabilized.

| Example 2: (Sample No. 2) | |
|---|---|
| (Lubricant composition) | Parts by weight |
| Natural graphite (crystalline) | 65 |
| Polyvinyl acetate resin | 35 |

-continued

| Example 2: (Sample No. 2) | |
|---|---|
| (Lubricant composition) | Parts by weight |
| Sodium salt of humic acid | 0.05 |

The above composition was added with water to form a dispersion. The concentration of the above composition in the dispersion was 45 wt.%. The dispersion was continuously applied during the hot-rolling of 300 seamless steel pipes on a mandrel mill. A mandrel bar which was moving at a speed of 2.0 m/sec was coated with the lubricant by means of the airless sprayer. During that time, the surface temperature of the mandrel bar ranged from 150° C. to 350° C. The resultant films of the lubricant were all uniform and adhered firmly. They had a thickness of from 40 μm to 50 μm. Compared with the conventional lubricant as Comparative Example B, more uniform and thicker films were formed.

As a result, the coefficient of friction was as small as 75% or less compared with the comparative example, leading to improvements such that the mill-driving power consumption was reduced by about 20% and the rolling operation was stabilized.

| Example 3: (Sample No. 3) | |
|---|---|
| (Lubricant composition) | Parts by weight |
| Natural graphite (crystalline) | 65 |
| Polyvinyl acetate resin | 34.5 |
| Ammonium salt of nitrohumic acid | 0.5 |

The above composition was added with water to form a dispersion. The concentration of the above composition in the dispersion was 45 wt.%. The dispersion was continuously applied during the hot-rolling of 400 seamless steel pipes on a mandrel mill. A mandrel bar which was moving at a speed of 2.0 m/sec was coated with the lubricant by means of the airless sprayer. During that time, the surface temperature of the mandrel bar ranged from 150° C. to 350° C. The resultant films of the lubricant were all uniform and adhered firmly. They had a thickness of from 40 μm to 55 μm. Compared with the conventional lubricant as Comparative Example B, more uniform and thicker films were formed.

As a result, the coefficient of friction was as small as 75% or less compared with the comparative example, leading to improvements such that the mill-driving power consumption was reduced by about 20% and the rolling operation was stabilized.

| Example 4: (Sample No. 4) | |
|---|---|
| (Lubricant composition) | Parts by weight |
| Natural graphite (crystalline) | 65 |
| Polyacrylic resin | 34 |
| Sodium salt of lignin sulfonic acid | 1 |

The above composition was added with water to form a dispersion. The concentration of the above composition in the dispersion was 45 wt.%. The dispersion was continuously applied during the hot-rolling of 350 seamless steel pipes on a mandrel mill. A mandrel bar which was moving at a speed of 2.0 m/sec was coated with the lubricant by means of the airless sprayer. During that time, the surface temperature of the mandrel bar ranged from 150° C. to 350° C. The resultant films of the lubricant were all uniform and adhered firmly They had a thickness of from 45 μm to 55 μm. Compared with the conventional lubricant as Comparative Example A, more uniform and thicker films were formed.

As a result, the coefficient of friction was as small as 70% or less compared with the comparative example, leading to improvements such that the mill-driving power consumption was reduced by about 20% and the rolling operation was stabilized.

| Example 5: (Sample No. 5) | |
|---|---|
| (Lubricant composition) | Parts by weight |
| Natural graphite (crystalline) | 65 |
| Polyacrylic resin | 31 |
| Ammonium salt of humic acid | 3 |
| Sodium salt of lignin sulfonic acid | 1 |

The above composition was added with water to form a dispersion. The concentration of the above composition in the dispersion was 45 wt.%. The dispersion was continuously applied during the hot-rolling of 400 seamless steel pipes on a mandrel mill. A mandrel bar which was moving at a speed of 2.0 m/sec was coated with the lubricant by means of the airless sprayer. During that time, the surface temperature of the mandrel bar ranged from 150° C. to 350° C. The resultant films of the lubricant were all uniform and adhered firmly. They had a thickness of from 45 μm to 55 μm. Compared with the conventional lubricant as Comparative Example A, more uniform and thicker films were formed.

As a result, the coefficient of friction was as small as 70% or less compared with the comparative example, leading to improvements such that the mill-driving power consumption was reduced by about 20% and the rolling operation was stabilized.

Experiment and Examples with Gilsonite

Figure 2:
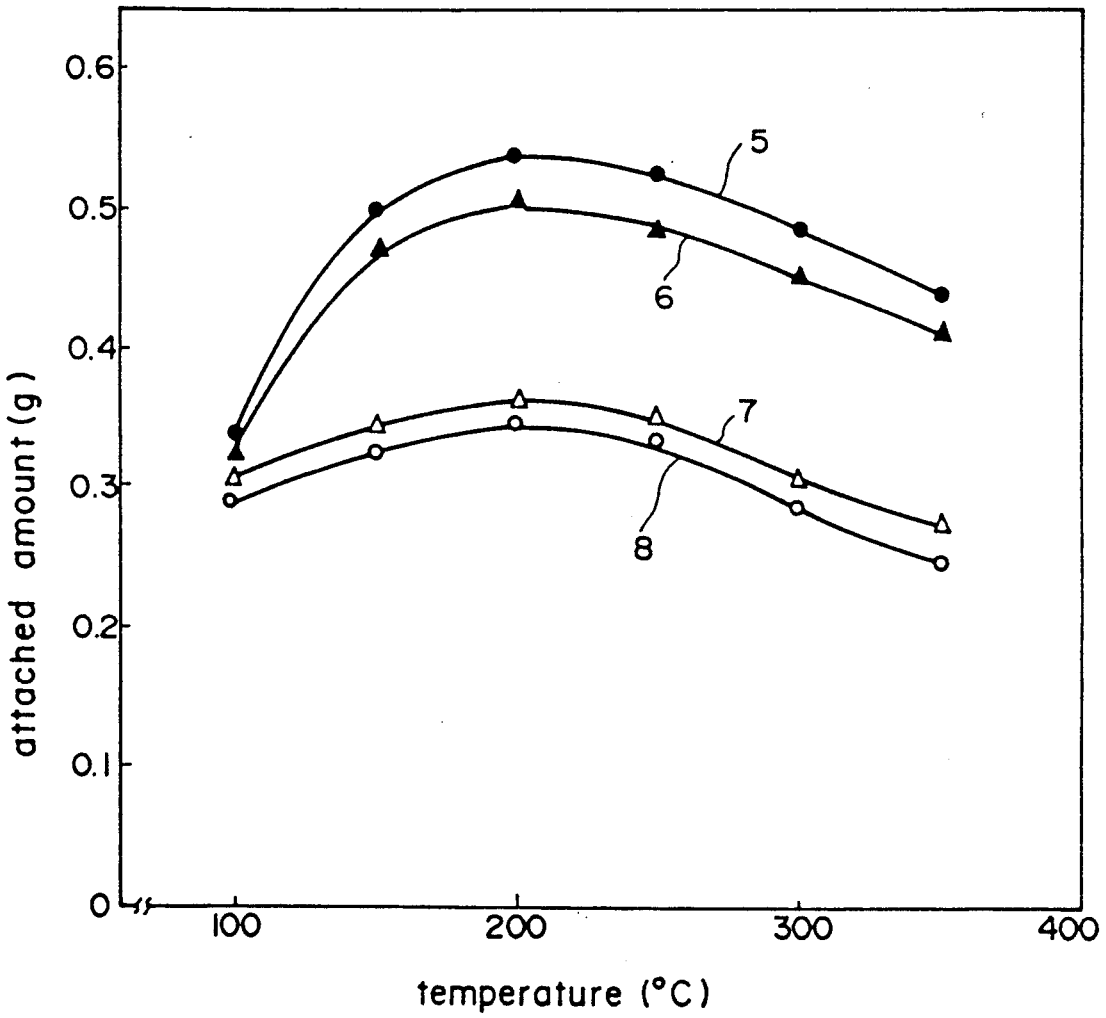
FIG. 2 diagrammatically shows the adhesion of the lubricants of Invention Examples 6 and 10 and the lubricants of Comparative Examples C and D.

Regarding the compositions given in Table 3, their adhesion, namely, adhered amounts and uniformity of films were investigated. The results are shown in FIG. 2 and Table 4.

The experiment was conducted in the same manner as in Experiment 1.

TABLE 3

| | Compositions of Sample Lubricants | | | | | | |
|---|---|---|---|---|---|---|---|
| | Example | | | | | Comp. Ex. | |
| Sample No. | 6 | 7 | 8 | 9 | 10 | C | D |
| Natural graphite (amorphous) | 70 | 70 | 70 | 70 | 70 | 60 | 80 |
| Gilsonite | 10 | 10 | 10 | 10 | 10 | 20 | 10 |
| Polyacrylic resin (Tg: 65° C.) | 20 | | | 19 | 17 | | 10 |
| Polyvinyl acetate resin (Tg: 30° C.) | | 20 | 19.5 | | | 20 | |
| Ammonium salt of humic acid | 0.02 | | | | 2 | | |
| Sodium salt of humic acid | | 0.05 | | | | | |
| Ammonium salt of nitrohumic acid | | | 0.5 | | | | |
| Sodium salt of lignin sulfonic acid | | | | 1 | 1 | | |

Remarks:
(1) Sample C is one of the examples of U.S. Pat. Specification No. 4,711,733, while Sample D is one of the examples of Japanese Patent Publication No. 34356/1987.
(2) Samples 6–10 are lubricants according to this invention.
(3) The proportions are expressed in terms of parts by weight.
(4) Tg is an abbreviation of glass transition point.
(5) In FIG. 2, Curves 5, 6, 7 and 8 correspond to Sample Nos. 7, 6, D and C, respectively.

TABLE 4

| Uniformity of Coated Films | | | | | | | |
|---|---|---|---|---|---|---|---|
| Temperature of steel pipe (°C.) | Sample No. | | | | | | |
| | 6 | 7 | 8 | 9 | 10 | C | D |
| 60 | B | B | B | B | B | B | B |
| 100 | B | B | B | B | B | B | B |
| 150 | A | A | A | A | A | C | C |
| 200 | A | A | A | A | A | C | C |
| 250 | A | A | A | A | A | C | C |
| 300 | A | A | A | A | A | C | C |
| 350 | A | A | A | A | A | C | C |
| 400 | A | A | A | A | A | C | C |

Remarks:
A: Very dense and uniform dry film was formed.
B: Undried film was formed.
C: Extremely non-uniform film was formed.

| Example 6: (Sample No. 6) | |
|---|---|
| (Lubricant composition) | Parts by weight |
| Natural graphite (amorphous) | 70 |
| Gilsonite | 10 |
| Polyacrylic resin | 20 |
| Ammonium salt of humic acid | 0.02 |

A dispersion which had been prepared by adding water to the above composition to give a concentration of 45 wt.% was continuously applied during the hot-rolling of 200 seamless steel pipes on a mandrel mill. A mandrel bar which was moving at a speed of 2.0 m/sec was coated with the lubricant by means of the airless sprayer. During that time, the surface temperature of the mandrel bar ranged from 100° C. to 250° C. The resultant films of the lubricant were all uniform and adhered firmly. They had a thickness of from 30 μm to 40 μm. Compared with the conventional lubricant as Comparative Example D, more uniform and thicker films were formed. As a result, the coefficient of friction was as small as 80% or less compared with the comparative example, leading to improvements such that the mill-driving power consumption by about 15% and the rolling operation was stabilized.

| Example 7: (Sample No. 7) | |
|---|---|
| (Lubricant composition) | Parts by weight |
| Natural graphite (amorphous) | 70 |
| Gilsonite | 10 |
| Polyvinyl acetate resin | 20 |
| Sodium salt of humic acid | 0.05 |

A dispersion which had been prepared by adding water to the above composition to give a concentration of 45 wt.% was continuously applied during the hot-rolling of 300 seamless steel pipes on a mandrel mill. A mandrel bar which was moving at a speed of 2.0 m/sec was coated with the lubricant by means of the airless sprayer. During the operation, the surface temperature of the mandrel bar ranged from 150° C. to 350° C. The resultant films of the lubricant were all uniform and adhered firmly. They had a thickness of from 40 μm to 50 μm. Compared with the conventional lubricant as Comparative Example C, more uniform and thicker films were formed. As a result, the coefficient of friction was as small as 75% or less compared with the comparative example, leading to improvements such that the mill-driving power consumption by about 20% and the rolling operation was stabilized.

Example 8: (Sample No. 8)

| (Lubricant composition) | Parts by weight |
|---|---|
| Natural graphite (amorphous) | 70 |
| Gilsonite | 10 |
| Polyvinyl acetate resin | 19.5 |
| Ammonium salt of nitrohumic acid | 0.5 |

A dispersion which had been prepared by adding water to the above composition to give a concentration of 45 wt.% was continuously applied during the hot-rolling of 400 seamless steel pipes on a mandrel mill. A mandrel bar which was moving at a speed of 2.0 m/sec was coated with the lubricant by means of the airless sprayer. During the operation, the surface temperature of the mandrel bar ranged from 150° C. to 350° C. The resultant films of the lubricant were all uniform and adhered firmly. They had a thickness of from 40 μm to 55 μm. Compared with the conventional lubricant as Comparative Example C, more uniform and thicker films were formed. As a result, the coefficient of friction was as small as 75% or less compared with the comparative example, leading to improvements such that the mill-driving power consumption by about 20% and the rolling operation was stabilized.

Example 9: (Sample No. 9)

| (Lubricant composition) | Parts by weight |
|---|---|
| Natural graphite (amorphous) | 70 |
| Gilsonite | 10 |
| Polyacrylic resin | 19 |
| Sodium salt of lignin sulfonic acid | 1 |

A dispersion which had been prepared by adding water to the above composition to give a concentration of 45 wt.% was continuously applied during the hot-rolling of 400 seamless steel pipes on a mandrel mill. A mandrel bar which was moving at a speed of 2.0 m/sec was coated with the lubricant by means of the airless sprayer. During the operation, the surface temperature of the mandrel bar ranged from 150° C. to 300° C. The resultant films of the lubricant were all uniform and adhered firmly. They had a thickness of from 45 μm to 55 μm. Compared with the conventional lubricant as Comparative Example D, more uniform and thicker films were formed. As a result, the coefficient of friction was as small as 70% or less compared with the comparative example, leading to improvements such that the mill-driving power consumption by about 20% and the rolling operation was stabilized.

Example 10: (Sample No. 10)

| (Lubricant composition) | Parts by weight |
|---|---|
| Natural graphite (amorphous) | 70 |
| Gilsonite | 10 |
| Polyacrylic resin | 17 |
| Ammonium salt of humic acid | 2 |
| Sodium salt of lignin sulfonic acid | 1 |

A dispersion which had been prepared by adding water to the above composition to give a concentration of 45 wt.% was continuously applied during the hot-rolling of 400 seamless steel pipes on a mandrel mill. A mandrel bar which was moving at a speed of 2.0 m/sec was coated with the lubricant by means of the airless sprayer. During the operation, the surface temperature of the mandrel bar ranged from 150° C. to 350° C. The resultant films of the lubricant were all uniform and adhered firmly. They had a thickness of from 45 μm to 55 μm. Compared with the conventional lubricant as Comparative Example D, more uniform and thicker films were formed. As a result, the coefficient of friction was as small as 70% or less compared with the comparative example, leading to improvements such that the mill-driving power consumption by about 20% and the rolling operation was stabilized.

What is claimed is:

1. In a lubricant for the production of seamless steel pipes comprising graphite powder, a water-soluble particulate synthetic resin and water, the improvement wherein said lubricant further comprises not less than 0.01 weight percent of a salt of a polybasic high molecular acid selected from the group consisting of sodium, potassium, calcium, magnesium, ammonium and amine salts of humic, nitrohumic and lignin sulfonic acids and mixtures of said salts.

2. The lubricant as defined in claim 1, wherein the graphite powder has an average particle size not greater than 100 μm.

3. The lubricant as defined in claim 1, further comprising gilsonite powder.

4. The lubricant as defined in claim 3, wherein the gilsonite powder has an average particle size not greater than 100 μm.

5. The lubricant as defined in any one of claims 3 and 4, wherein the fine gilsonite powder is contained at a concentration of 5–30 wt.% in the lubricant.

6. The lubricant as defined in claim 1, wherein the salt of the polybasic high molecular acid is present in a concentration of 0.01–5 wt.% in the lubricant.

7. The lubricant as defined in claim 1, wherein the particulate synthetic resin is selected from the group consisting of polyacrylic resins, polyvinyl acetate resins, polystyrene resins, polyethylene resins, polyepoxy resins, and mixtures thereof.

8. The lubricant as defined in claim 1, wherein the particulate synthetic resin is present in a concentration of 15–40 wt.% in the lubricant.

* * * * *